United States Patent [19]

Cox

[11] Patent Number: 4,470,104

[45] Date of Patent: Sep. 4, 1984

[54] AUTOMOTIVE INNER-BULB ASSEMBLY

[75] Inventor: Charles W. Cox, Willoughby, Ohio

[73] Assignee: General Electric Company, Schenectady, N.Y.

[21] Appl. No.: 334,113

[22] Filed: Dec. 24, 1981

[51] Int. Cl.[3] ..... F21M 3/30

[52] U.S. Cl. ..... 362/211; 362/61; 362/396; 362/296; 362/444; 362/310; 362/375; 313/113; 313/318

[58] Field of Search ..... 362/61, 211, 297, 362, 362/267, 308, 310, 375, 296, 396, 444; 313/318, 634, 578, 579, 580, 25, 113

[56] References Cited

U.S. PATENT DOCUMENTS

| | | | |
|---|---|---|---|
| 3,206,713 | 9/1965 | Horan | 313/318 X |
| 3,534,213 | 10/1970 | Simon et al. | 313/634 X |
| 3,622,832 | 11/1971 | Schlessel et al. | 313/113 X |
| 3,898,506 | 8/1975 | Wright . | |
| 3,961,216 | 6/1976 | Edwards | 313/318 X |
| 3,974,370 | 8/1976 | Pearson . | |
| 3,979,627 | 9/1976 | Leadvaro et al. . | |
| 3,986,068 | 10/1976 | Albrecht . | |
| 4,081,708 | 3/1978 | Noteltiers | 313/113 |
| 4,146,814 | 3/1979 | Wojtowicz | 313/580 |
| 4,171,497 | 10/1979 | Shinoda | 313/113 |
| 4,243,907 | 1/1981 | Kohl et al. | 313/318 |
| 4,345,178 | 8/1982 | Pappas et al. | 313/318 X |
| 4,371,807 | 2/1983 | Eckhardt | 313/318 |
| 4,412,273 | 10/1983 | Helbig et al. | 313/113 X |

*Primary Examiner*—Peter A. Nelson

*Attorney, Agent, or Firm*—John F. McDevitt; Philip L. Schlamp; Fred Jacob

[57] ABSTRACT

An inner-bulb assembly for use in an automotive lamp unit such as a headlamp or foglamp unit comprising an inner-bulb, an electrically nonconductive base and a metallic spring clip. The base can be designed to retrofit an H3 type of base. Additionally the metallic spring clip serves to secure the assembly to the rest of the lamp unit and as an electrical conductor for one of the inner-bulb pin leads.

11 Claims, 5 Drawing Figures

Fig. 2
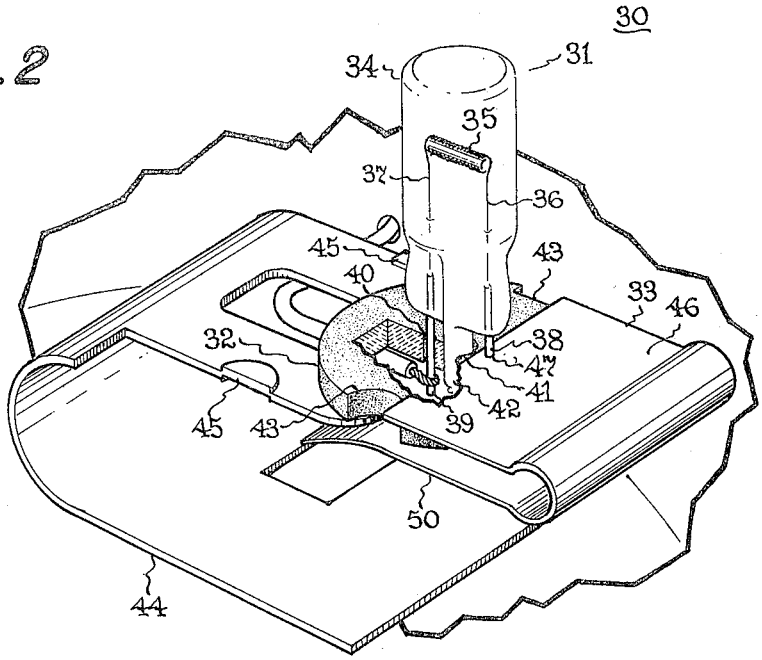
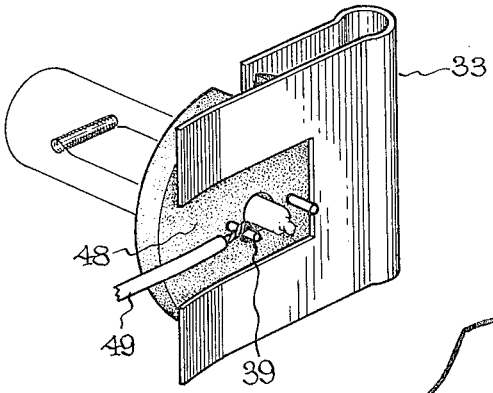
Fig. 3
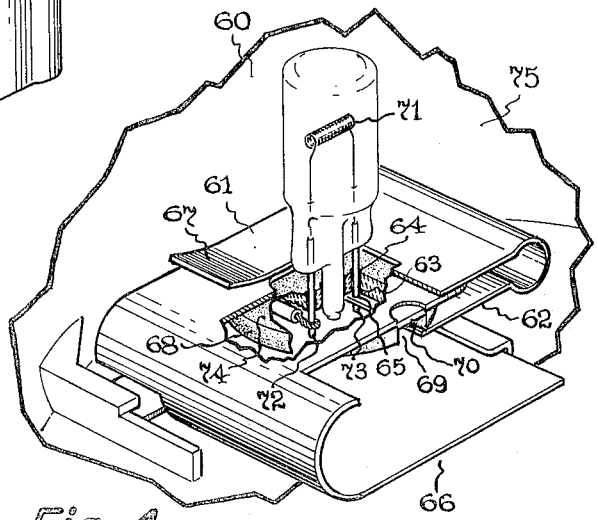
Fig. 4

AUTOMOTIVE INNER-BULB ASSEMBLY

BACKGROUND OF THE INVENTION

This invention relates to a light source within an automotive lamp unit and more particularly to a new and improved means of connecting and positioning an inner-bulb within an automotive lamp unit.

In the prior art, inner-bulb assemblies have been electrically connected and physically positioned within a lamp unit, such as a headlamp or foglamp unit, by numerous means. One particular means includes electrically and mechanically connecting a miniature lamp bulb to a metallic base. The base is comprised of a metallic, box-like portion, which holds the bulb in place and electrically connects one of the bulb pin leads by welding thereto and a metallic collar which slips over and is soldered to the box-like portion and is located at a predetermined reference distance with respect to the filament. An external wire is electrically connected to the other bulb pin lead. The inner-bulb assembly is disposed on a mounting bracket and held in place by an attachment means, such as a spring clip. Such a base and attachment means, however, require an unnecessary number of parts and increase the number of steps and costs involved in construction, all of which are serious drawbacks from a manufacturing viewpoint.

SUMMARY OF THE INVENTION

In view of the foregoing, it is an object of the present invention to provide a new and improved means of electrically and mechanically connecting an inner-bulb assembly to an automotive lamp unit.

Another object of the present invention is to provide a new and improved inner-bulb base for use in an automotive lamp unit.

The foregoing and other objects of the present invention are achieved by providing an electrically nonconductive base comprising a preferably flat piece of material with the bulb pin leads extending therethrough and an electrically conductive spring clip disposed about the base which is electrically and mechanically connected to one of the pin leads.

BRIEF DESCRIPTION OF THE DRAWINGS

FIG. 2 illustrates a preferred embodiment of an inner-bulb assembly, in accordance with the present invention, during mounting of the assembly within a lamp unit.

FIG. 3 is a perspective view illustrating a preferred embodiment of the inner-bulb assembly to be used in accordance with the present invention.

FIG. 4 illustrates an alternative embodiment of an inner-bulb assembly, in accordance with the present-invention, within a lamp unit.

DETAILED DESCRIPTION

Figure 1:
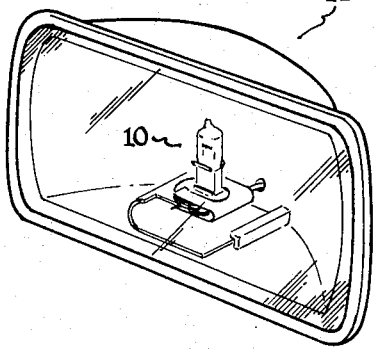
Fig. 1 (PRIOR ART)
FIG. 1 illustrates a perspective view of a prior art inner-bulb assembly within a lamp unit.
Figure 1A:
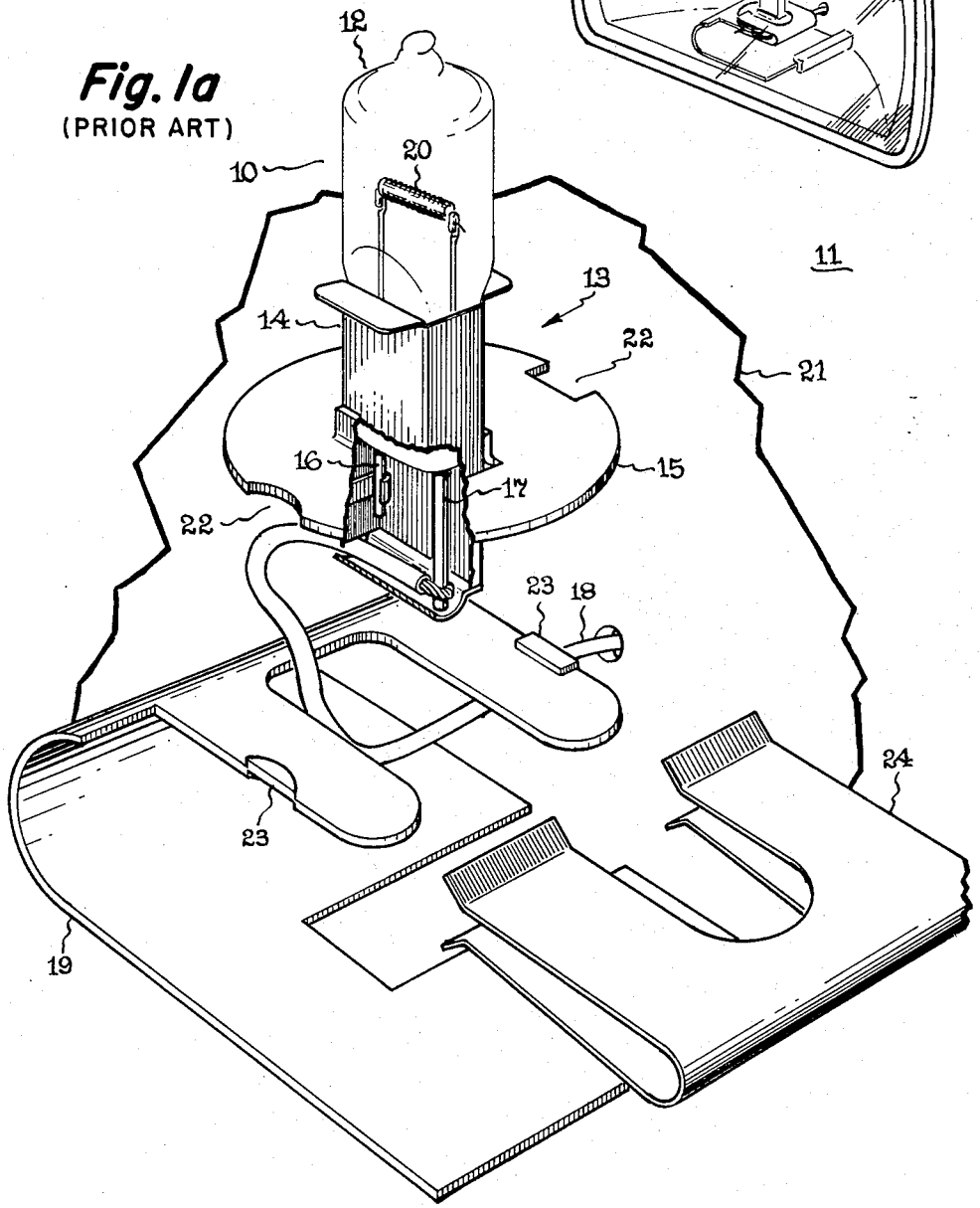
Fig. 1a (PRIOR ART)
FIG. 1A is an exploded view of a prior art inner-bulb assembly and spring clip.

Illustrated in FIG. 1 is an inner-bulb assembly 10 within a lamp unit 11 as used in the prior art. As shown in more detail in FIG. 1A, the assembly comprises an inner bulb 12 and base 13 wherein the base 13, commonly referred to as an H3 type base, includes a box-like, metallic shape portion 14 which seats and holds the inner bulb 12 and a metallic collar 15 disposed about the box-like shape 14. The cutaway sections of the box-like portion 14 and collar 15 expose two lamp pins 16 and 17 one of which, 16, is welded to the box-like shape 14 and the other, 17, to an external wire 18. The collar 15 is positioned and soldered about the box-like shape 14 such that the assembly 10, when mounted on a bracket 19, located within the lamp unit 11 will have the inner-bulb filament 20 prefocused with respect to the lamp reflector 21. Cutouts 22 located on the collar aid in positioning the assembly 10 on the bracket 19 by engaging bracket nibs 23 during mounting. A spring clip 24 is pushed around the collar 15 and bracket 19 to secure the assembly 10 to the bracket 19.

As shown in FIG. 2, the present invention provides a new and improved assembly by eliminating the prior art base 13 and incorporating the prior art spring clip 24 as part of the improved inner-bulb assembly. More specifically, the improved assembly 30 comprises an inner-bulb 31, a base 32, and spring clip 33. The inner-bulb 31 has a transparent, vitreous envelope 34 which can comprise glass or quartz and contains a gas-filled atmosphere or vacuum. For example, the inner-bulb 31 can comprise an incandescent, glass-halogen or quartz-halogen lamp. The envelope 34 encloses a filament 35 and inner lead wires 36 and 37 which are attached to the filament 35, for example by welding or clamping, and are integral with pin leads 38 and 39 respectively.

As shown in the cutaway section of the base in FIG. 2, the base 32 has apertures, such as aperture 40, through which the pin leads 38 and 39 extend. The base apertures are dimensioned such that those portions of the pin leads passing through the apertures create a frictional fit therebetween and thereby ensure that the base 32 will be unable to move about the pin leads 38 and 39 during normal operation of the assembly 30. An adhesive substance, such as cement, can be disposed between the base apertures and pin leads to further ensure that the base 32 is secured to the pin leads 38 and 39. If desired, an additional opening 41 can be provided to accommodate a bulb tip 42. The base 32 comprises any nonconductive material capable of withstanding high-temperatures without suffering an adverse effect, that is, a refractory material such as ceramic or plastic. One particular type of acceptable material is "Ryton", a trademark of Philips Petroleum Company. In one preferred embodiment and as shown in FIG. 2, the base 32 is in the shape of a disc with indentations 43 about the base periphery such that when the assembly 30 is mounted to a lamp unit bracket 44 the indentations 43 engage bracket dimples 45 and thereby acceptably position and prevent rotation of the base 32 during and after mounting of the inner-bulb assembly 30.

The spring clip 33 is disposed about the base 32 with the top of the clip 46 electrically and mechanically connected to pin lead 38 at clip aperture 47 to thereby prevent the spring clip 33 from moving about the pin lead 38.

As shown more clearly in FIG. 3, the clip 33 has an opening 48 to ensure that at least pin lead 39 does not come into electrical contact with clip 33 and can be connected to an external lead wire 49. Additionally, the spring clip 33 is an electrically conductive material such as a metal which can include such metals as phosphor bronze, stainless steel or brass. As for clip rigidity, the only requirement is that the clip be sufficiently rigid to ensure that the clip 33 securely holds the assembly 30 in place when mounted to the bracket 44.

As disclosed and as shown in FIG. 2, the assembly 30 can be easily and simply secured onto the bracket 44 by merely slipping the assembly 30 onto bracket 44, between the lower portion of the clip 50 and base 32, until base indentations 43 engage bracket dimples 45. Thus the spring clip 33 serves both to anchor the assembly 30 in position on the bracket and as an electrical conductor for pin lead 38. Alternatively, and as shown in FIG. 4, an inner-bulb assembly 60 can be constructed with the clip 61 flipped around such that lower portion of the clip 62 electrically and mechanically is connected to pin lead 63, through base aperture 64, at clip aperture 65. Assembly 60 could thus be mounted within, for example a headlamp unit, by slipping the assembly 60 onto the lamp unit bracket 66 between the upper portion of the clip 67 and the base 68 and by engaging base indentations 69 to bracket dimples 70.

In constructing either embodiment of the inner-bulb assembly, the bulb filament is at a predetermined reference distance from one or more elements of the inner-bulb assembly such that, when the assembly is positioned on the mounting bracket, the filament is accurately positioned with respect to a lamp unit reflector such as in a headlamp or foglamp unit. For example, as shown in FIG. 4 the filament 71 can be at a predetermined reference distance from pin lead ends 72 and 73 which in turn are at a predetermined reference distance from the base top 74. Inasmuch as the lamp unit bracket 66 can be predeterminedly and precisely positioned within the lamp unit, the filament 71, when the inner-bulb assembly 60 is slipped onto the bracket 66, can be accurately located with respect to the focal point of the reflector 75.

Thus the present invention as disclosed eliminates the need for a prior art base comprising a collar and box-like portion and a separate clip by providing a simple and compact assembly which incorporates the spring clip therein. Furthermore, there is no need to locate a collar at a predetermined reference distance from a bulb filament. Still further, by reducing the number of parts required and simplicity of mounting, the present invention also reduces the cost of manufacturing as compared to the prior art.

It should also be noted that while a single filament lamp has been utilized for purposes of description, a multifilament lamp can also be used. For example, the hot lead for each additional filament would pass through a corresponding additional base aperture and connect to a corresponding additional external lead wire.

While preferred embodiments of the invention have been shown and described, various other embodiments and modifications thereof will become apparent to persons skilled in the art and will fall within the spirit and scope of the invention as defined in the following claims.

What I claim as new and desire to secure by Letters Patent of the United States is:

1. An automotive lamp unit having a reflector, mounting member, and inner-bulb assembly located at a predetermined reference distance within the lamp unit wherein said inner-bulb assembly comprises the elements of:

(a) an inner bulb having one or more filaments and at least two pin leads;

(b) an electrically, nonconductive flat disc providing sole support means for said inner bulb by means of a pair of apertures in which said pin leads are frictionally fitted while extending therethrough and prevent significant disc rotation;

(c) an electrically conductive clip physically gripping both major surfaces of said disc, connected both electrically and mechanically to a first of said pin leads by means of a third aperture through which said pin lead extends, and which secures said assembly to said mounting member located within said lamp unit without significant clip rotation; and (d) one or more external lead wires wherein each of said external lead wires is connected to a corresponding pin lead, other than to said first pin lead.

2. An assembly as defined in claim 1 wherein each of said bulb filaments is at a predetermined reference distance from one or more of said assembly elements, to ensure, that when said assembly is positioned on said mounting member, that each of said filaments is accurately positioned with respect to said reflector.

3. An assembly as defined in claim 1 wherein said base includes indentations along the base periphery to engage dimples on said mounting member and thereby acceptably position and prevent rotation of said base within said lamp unit.

4. An assembly as defined in claim 1 wherein a frictional fit is provided between said base apertures and portions of said pin leads extending therethrough.

5. An assembly as defined in claim 4 wherein an adhesive substance is disposed between said base apertures and said pin lead portions.

6. An assembly as defined in claim 1 wherein said base is a refractory, dielectric material.

7. An assembly as defined in claim 1 wherein said base is in the shape of a disc.

8. An assembly as defined in claim 1 wherein said base has an additional opening to provide clearance for a bulb tip.

9. An assembly as defined in claim 1 wherein a frictional fit is provided between an aperture in said clip and portion of said first pin lead extending therethrough.

10. An assembly as defined in claim 1 wherein said clip material is metallic.

11. An automotive lamp unit having a reflector, mounting bracket, and inner-bulb assembly wherein said inner bulb assembly comprises the elements of:

(a) an inner-bulb having a filament and pin leads wherein said filament is at a predetermined reference distance from one or more of said assembly elements to ensure, that when said assembly is positioned on said mounting bracket, that said filament is accurately positioned with respect to said reflector;

(b) a refractory, dielectric base, in the shape of a flat disc providing sole support means for said inner bulb by means of two apertures wherein said pin leads extend therethrough and provide a frictional fit therebetween and preventing significant disc rotation, an opening to provide clearance for a bulb tip, and indentations along the base periphery to engage dimples on said mounting bracket and thereby acceptably position and further prevent significant rotation of said disc within said lamp unit;

(c) a metallic clip physically gripping both major surfaces of said disc, connected both electrically and mechanically to a first of said pin leads, providing a frictional fit between a clip aperture and a portion of said first pin lead extending therethrough, and securing said assembly to said mounting bracket located within said lamp unit without significant clip rotation; and (d) one or more external lead wires wherein each of said external lead wires is connected to a corresponding pin lead, other than to said first pin lead.

* * * * *